US011033064B2

(12) United States Patent
Aharouni

(10) Patent No.: US 11,033,064 B2
(45) Date of Patent: Jun. 15, 2021

(54) INTERNAL PROTECTION DEVICE FOR A HELMET AND HELMET EQUIPPED THEREWITH

(71) Applicant: Charles Aharouni, Puteaux (FR)

(72) Inventor: Charles Aharouni, Puteaux (FR)

( * ) Notice: Subject to any disclaimer, the term of this patent is extended or adjusted under 35 U.S.C. 154(b) by 126 days.

(21) Appl. No.: 16/088,513

(22) PCT Filed: May 27, 2016

(86) PCT No.: PCT/FR2016/051272
§ 371 (c)(1),
(2) Date: Sep. 26, 2018

(87) PCT Pub. No.: WO2017/168058
PCT Pub. Date: Oct. 5, 2017

(65) Prior Publication Data

US 2019/0116910 A1 Apr. 25, 2019

(30) Foreign Application Priority Data

Mar. 31, 2016 (FR) ..... 1652851

(51) Int. Cl.
*A42B 3/12* (2006.01)
*A42B 3/32* (2006.01)

(52) U.S. Cl.
CPC ..... *A42B 3/122* (2013.01); *A42B 3/328* (2013.01)

(58) Field of Classification Search
CPC ..... A42B 3/122; A42B 3/32
See application file for complete search history.

(56) References Cited

U.S. PATENT DOCUMENTS 5,263,203 A 11/1993 Kraemer et al.
6,178,560 B1 1/2001 Halstead et al.

FOREIGN PATENT DOCUMENTS

EP 0332925 A1 9/1989
FR 2888729 A1 1/2007

OTHER PUBLICATIONS

Written Opinion in corresponding PCT Application No. PCT/FR2016/051272, dated Dec. 13, 2016 (an English translation attached hereto).
International Search Report in corresponding PCT Application No. PCT/FR2016/051272, dated Dec. 13, 2016 (an English translation attached hereto).

*Primary Examiner* — Katherine M Moran
(74) *Attorney, Agent, or Firm* — Leason Ellis LLP

(57) ABSTRACT

The invention relates to an internal protection device for a helmet (2) comprising a hard outer shell (4), a flexible inner cap (6) arranged inside the shell (4), and a chain of air cushions (8) designed to be placed inside the helmet (2), between the head that is to be protected and the flexible inner cap (6). The flexible inner cap (6) comprises a layer of thickness (E) within which there is created a plurality of cavities (**100-*n*) of which the shape, number, respective depth (P) and arrangement are chosen, dimensioned and combined with the air cushions (10-*n*) so as to improve the shock absorbing properties of the helmet and cover the parts of the user's head that are to be protected when the air cushions (8**) are filled with air, while allowing simple removal from the helmet when the air cushions are deflated.

10 Claims, 3 Drawing Sheets

INTERNAL PROTECTION DEVICE FOR A HELMET AND HELMET EQUIPPED THEREWITH

CROSS-REFERENCE TO RELATED PATENT APPLICATIONS

This application is a U.S. National Stage Application under 35 U.S.C. § 371 of International Patent Application No. PCT/FR2016/051272, filed 27 May 2016, which claims the benefit of priority under 35 U.S.C. Section 119(e) of French Patent Application number 1652851 filed 31 Mar. 2016, both of which are incorporated by reference in their entireties. The International Application was published on 5 Oct. 2017, as International Publication No. WO 2017/168058 A1.

The present invention relates to an internal protection device for a helmet and to a helmet equipped therewith.

It finds general application in the cranial protection of users of hard-shell helmets such as those worn by operators of motor vehicles having two or more wheels.

It is known that, during a motor vehicle accident involving a motorcyclist, the removal of the helmet is not without repercussions for a traumatized cervical vertebral column. Such removal by strong traction on the axis can lead to neurological complications that are sometimes irreversible in an unconscious motorcyclist. Non-removal of the helmet is often incompatible with the clearance of the upper airway during the initial stage of the rescue.

Internal protection devices for a helmet are already known which comprise a hard outer shell, a flexible inner cap arranged inside the shell, and a chain of air cushions placed inside the helmet between the head to be protected and the inner cap. In practice, the chain of air cushions comprises a valve that opens to the outside of the helmet so as to enable emergency deflation by rescuers.

Even though the air cushions can be deflated quickly and easily on the roadway by rescuers, a helmet that is equipped in this way does not provide total satisfaction in terms of protection against violent impacts.

It is the object of the invention to further improve the situation.

One object in particular is to provide a helmet whose shock-absorbing properties are improved over the helmets of the prior art.

To achieve this, the invention relates to an internal protection device for a helmet comprising a hard outer shell, a flexible inner cap arranged inside the shell, and a chain of air cushions designed to be placed inside the helmet between the flexible inner cap and the head to be protected.

According to a general definition of the invention, the flexible inner cap comprises a layer of flexible material of a predefined thickness inside which a plurality of cavities are formed whose shape, number, depth, and arrangement are chosen, dimensioned, and combined with the air cushions so as to improve the shock-absorbing properties of the helmet and cover the parts of the user's head that are to be protected when the air cushions are filled with air while allowing simple removal of the helmet when the air cushions are deflated.

Surprisingly, the applicant has observed that the number, size, and depth of the cavities or alveoli formed in the flexible inner cap and the combination thereof with the air cushions not only enable good anchoring of the cushions in the cap, but also deformation by bending and/or buckling of the flexible cap under the pressure of the air cushions in the event of impact, which further improves the shock-absorbing properties of the helmet.

According to certain embodiments, the device also comprises one or more of the following features, either individually or in any technically possible combination:

- The thickness of the inner cap is between 20 to 45 mm, inclusive, depending on the size of the helmets.
- The depth of the cavities is of the order of 10 to 25 mm depending on the size of the helmets.
- The chain of air cushions is formed by two plastic walls bonded together around their periphery and comprises a main band formed by a plurality of air cushions for protecting the user's neck, a first side band joined to the main band and formed by a plurality of air cushions for protecting one temple and one cheek of the user, a second side band joined to the main band and formed by a plurality of air cushions for protecting the other temple and the other cheek of the user; and a central band joined to the main band between the first and second side bands and formed by a plurality of air cushions for protecting the user's neck and parietal bone, while the cavities are designed to respectively house each air cushion arranged in this way in order to protect the sensitive parts of the user.
- The air cushions are identical in size and spherical shape and have a diameter of between 2 and 6 cm depending on the size of the helmets.
- The air pocket comprises a valve that opens to the outside of the helmet so as to enable emergency deflation by rescuers.
- The valve is located on an external lateral face of the hard shell of the helmet.
- The valve comprises a tip made of soft material that is protected by a removable rigid shell and fitted to the hard shell of the helmet.
- The device further comprises an associated inflation system.

The present invention also relates to a hard-shell helmet comprising an internal protection device according to any one of the preceding features.

Other advantages will become apparent in light of the description, in which.

Figure 1:
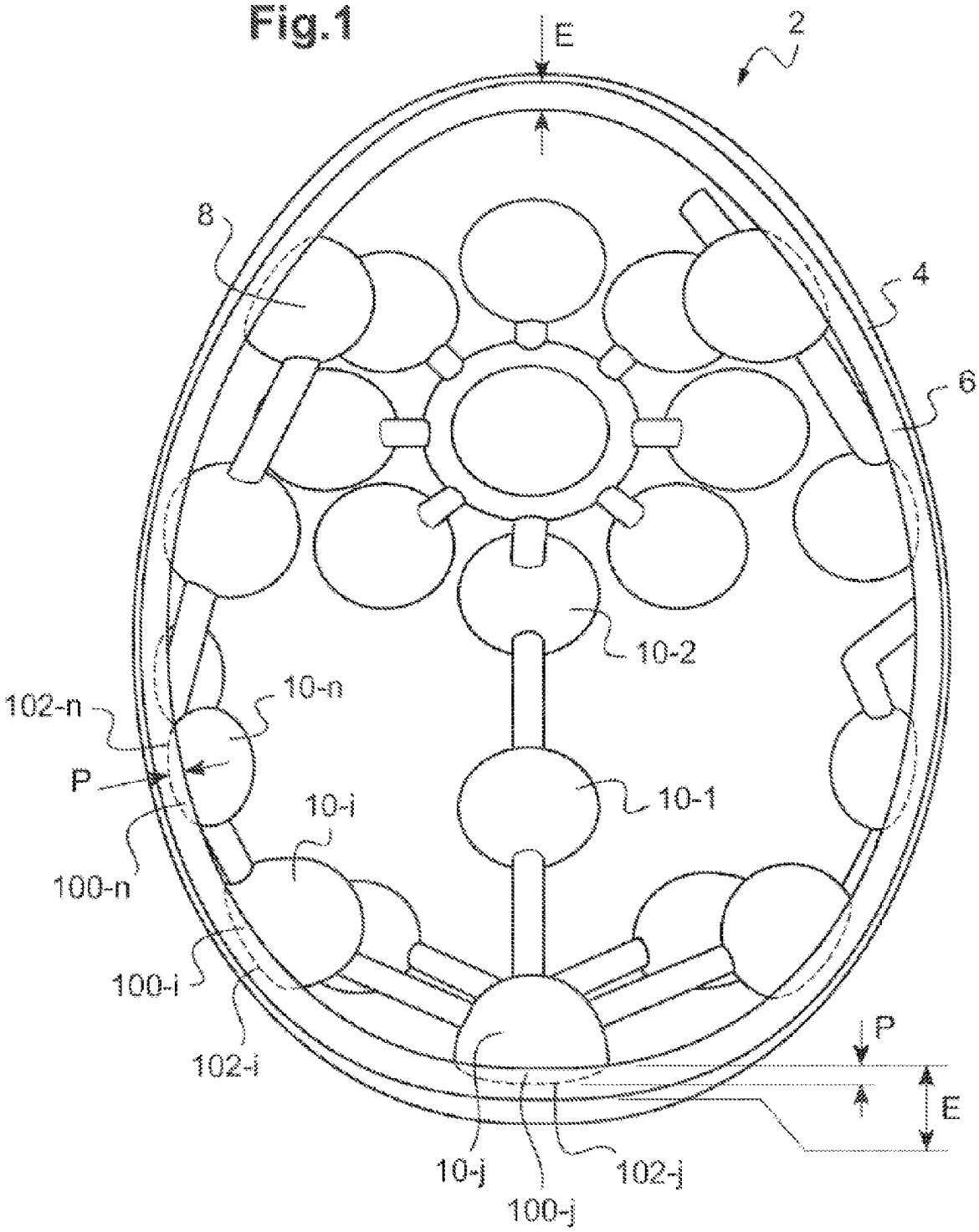
FIG. 1 shows a schematic view of the protection device according to the invention in which the air cushions are anchored in the cavities of the inner cap, seen from below.
Figure 2:
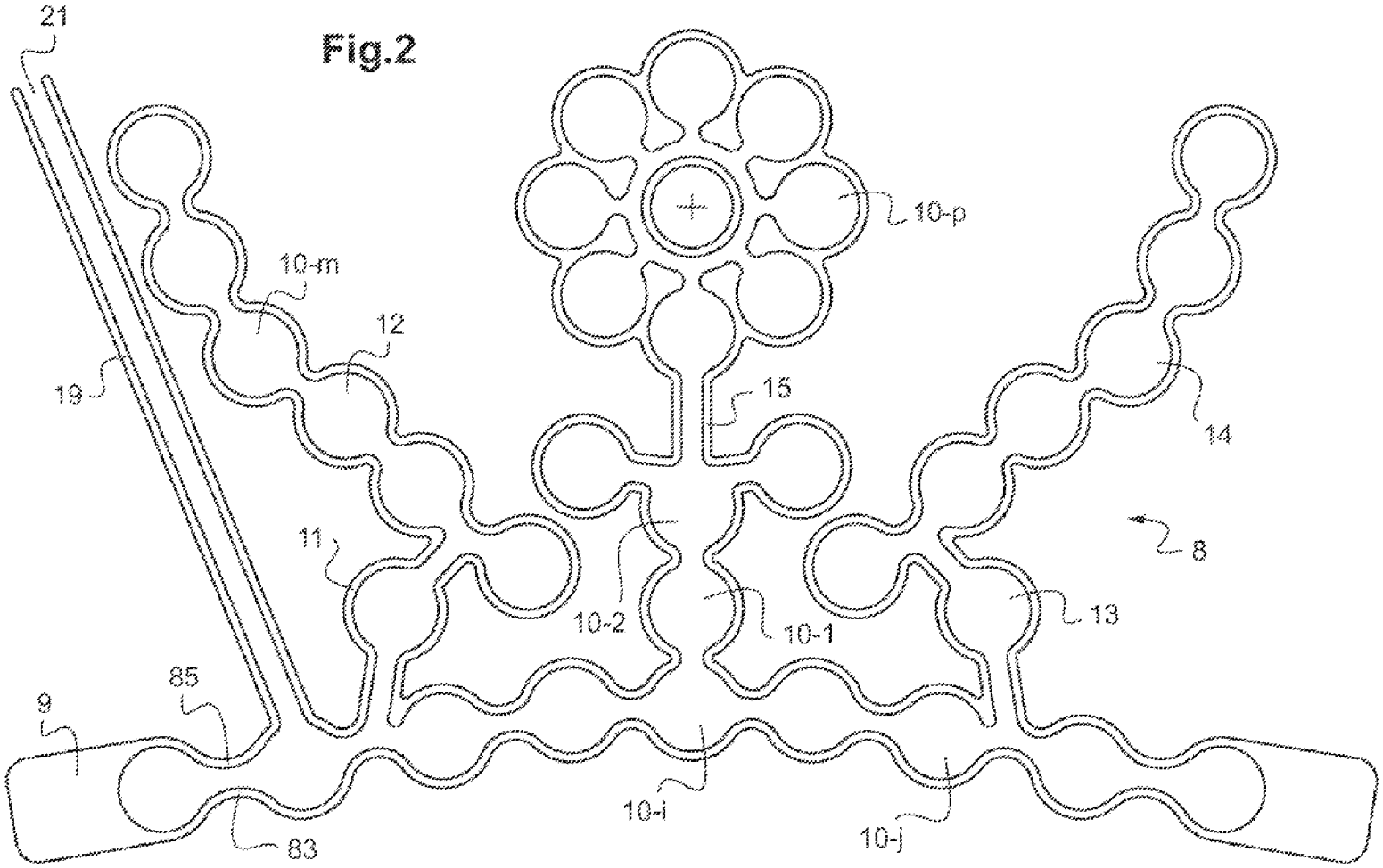
FIG. 2 shows a schematic view of the chain of air cushions according to the invention, placed outside the helmet.
Figure 3:
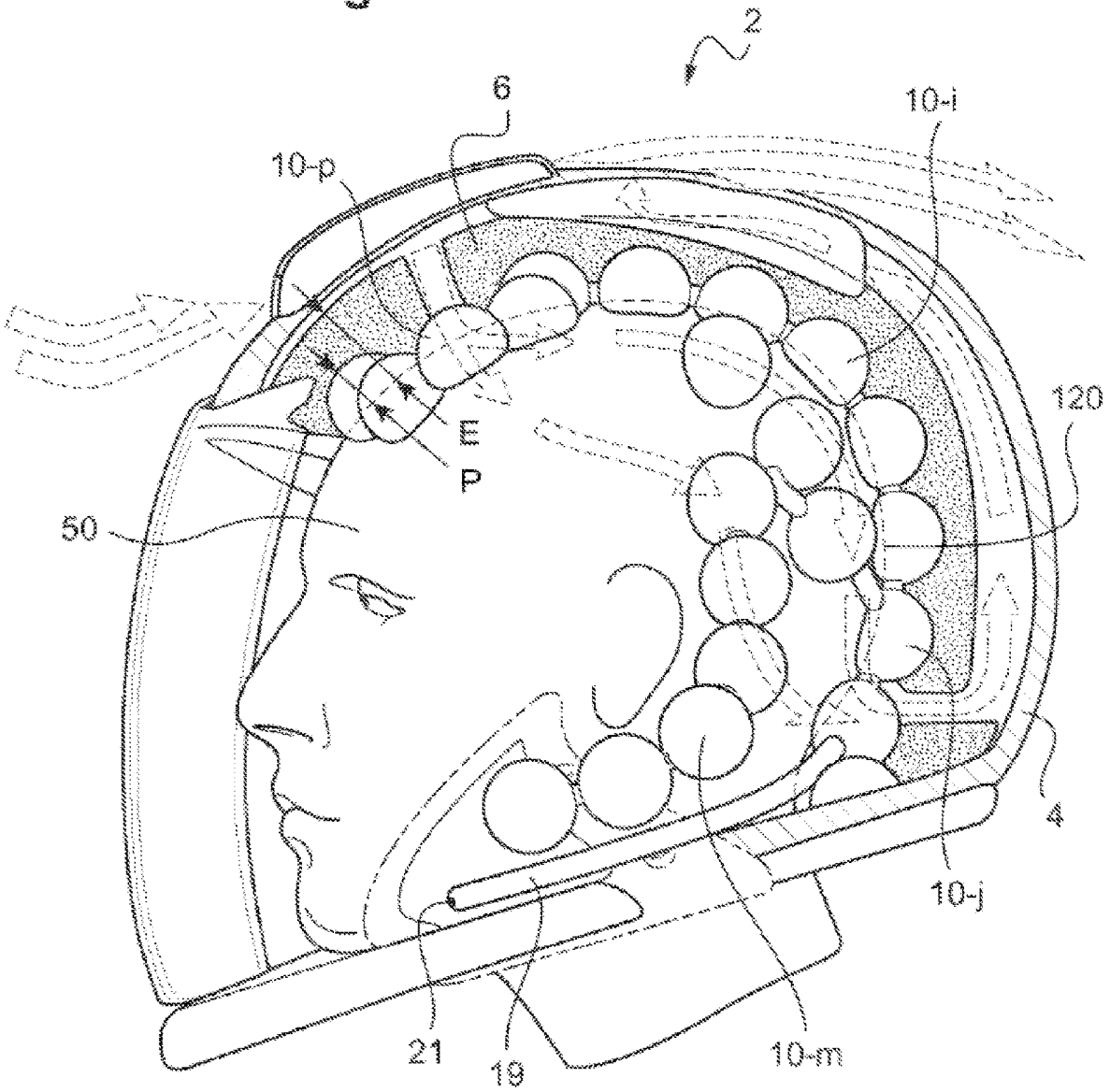
FIG. 3 shows a schematic side view of the helmet according to the invention while protecting the head of a manikin.

With reference to FIGS. 1 to 3, the helmet 2 comprises a hard outer shell 4, a flexible inner cap 6 arranged inside the shell 4, and a chain 8 of air cushions 10 placed inside the helmet between the head 50 to be protected (FIG. 3) and the flexible inner cap 6.

The chain 8 of air cushions will be described in greater detail with reference to FIG. 2. It defines a chain 8 of air cushions 10 that are uniquely identified as 10-1, 10-2, . . . **10-*i*, 10-*j*, . . . 10-*n*, 10-*m*, 10-*p*** . . . and connected to one another.

The outer hard shell 4 is composed of a single block. For example, it is made of polycarbonate (PC). Alternatively, it is made of acrylonitrile butadiene styrene (ABS).

The flexible inner cap 6 is made of flexible material, such as expanded polystyrene foam (EPF), for example. Alternatively, it can be made of expanded polypropylene (EPP).

The flexible cap 6 is designed to surround the head 50 to be protected.

The flexible cap 6 comprises a layer of flexible material of thickness E. Very advantageously, a plurality of cavities 100, which are uniquely identified as 100-1, 100-2, . . . **100-*i*, 100-*j*, . . . 100-*n*, 100-*m*, 100-*p* . . . and represented by weakening lines 102, which are uniquely identified as 102-1, 102-2, . . . 102-*i*, 102-*j*, . . . 102-*n*, 102-*m*, 102-*p* . . . of respective depth P, are formed inside the layer of the inner cap 6. For example, the cavities 100 are made during the manufacture of the helmet with the aid of a method 30**.

The thickness E of the inner cap is between 20 mm and 45 mm, inclusive, depending on the size of the helmets.

The depth P of the cavities 100 is of the order of E/2 and ranges between 10 mm and 25 mm, inclusive, depending on the size of the helmets.

The invention is based on the fact that the number, depth, and arrangement of the cavities 100 of the cap are chosen, dimensioned, and combined with the air cushions not only in order enable good anchoring of the cushions in the flexible cap, but above all deformation by bending and/or buckling of the flexible cap under the pressure of the air cushions in the event of impact, which further improves the shock-absorbing properties of the helmet.

For example, the applicant tested the helmet according to the invention in accordance with European standards ECE R22-05. The results of the shock absorption tests as well as the recordings over time of the accelerations suffered by the headforms show that the amount of energy transmitted to the skull is below the authorized limit of 275 g.

In practice, the air pocket 8 formed by the chain of air cushions is embodied as a single part (FIG. 2). It is formed by two walls 83 and 85 of plastic that are bound together on their periphery. The shape and arrangement of the chain of cushions 10 inside the inner cap 6 enables the parts of the user's head to be protected to be covered when the air bag is filled with air while allowing simple removal of the helmet 2 when the air pocket 8 is deflated.

The chain of air cushions 10 comprises a main band 9 formed by a plurality of air cushions for protecting the user's neck; a first side band 11 and 12 that is joined to the main band 9 and formed by a plurality of air cushions for protecting one temple (not shown) and one cheek (not shown) of the user; a second side band 13 and 14 joined to the main band 9 and formed by a plurality of air cushions for protecting the other temple (not shown) and the other cheek (not shown) of the user; and a central band 15 joined to the main band 9 between the first 11, 12 and second 13, 14 side bands and formed by a plurality of air cushions for protecting the user's neck and parietal bone. All of the sensitive parts of the user's head are thus protected in the event of violent impacts.

For a chosen helmet size, the main band 9 has a length on the order of 80 to 100 cm, for example.

In practice, the air cushions 10 are of identical size and spherical shape and have a diameter of the order of 2 to 6 cm.

The plastic material of the air pocket belongs to the group consisting of polyurethane, polyurethane ether platinum, polyamide, polyamide 235 Dtex.

For example, the plastic material is a 300 micrometer Platilon 4201 AU ether polyurethane wire.

According to another example, the plastic material is a polyamide 235 fabric that is coated with polyurethane on one or both sides.

In practice, the two walls 83 and 85 of the air pocket 8 are welded by means of an ultrasound machine.

The air pocket 8 comprises a valve 19 that opens to the outside of the helmet so as to enable emergency deflation by rescuers. In practice, the valve 19 is located on an external lateral face of the hard shell 4 of the helmet. Advantageously, the valve 19 comprises a tip 21 made of soft material that is protected by a removable rigid shell (not shown) and fitted to the hard shell 4 of the helmet.

According to yet another embodiment, the device further comprises an associated mini-compressor-type inflation system that is incorporated in the helmet (not shown). Alternatively, the inflation can be performed by the user or by fixed industrial pre-inflation.

In practice, the inflation pressure is on the order of 1.5 to 2.5 bars, which provides good protection against violent impacts.

For example, a thin covering membrane 120 (FIG. 3) covers the face of the chain 8 of air cushions that is in contact with the user's head 50.

The shape and arrangement of the chain of air cushions 10 combined with the cavities 100 of the inner cap not only provides protection against impacts when the air bag is inflated but also good air circulation to the interior of the helmet, which prevents sweating of the head. In addition, the chain of air cushions is easy to remove from the helmet, making it easy to clean both the inside and the outside of the helmet. Likewise, the chain of cushions is secured automatically inside the cavities of the inner cap of the helmet by air pressure, without any additional fixation.

The invention claimed is:

1. An internal protection device for a helmet (2), comprising a hard outer shell (4), a flexible inner cap (6) arranged inside the shell (4) of the helmet (2), and a chain (8) of air cushions designed to be placed inside the helmet (2) between the flexible inner cap (6) and the head to be protected and removable therefrom from the helmet, characterized in that the flexible inner cap (6) comprises a layer of flexible material of a predefined thickness € inside which a plurality of cavities (100) are formed whose shape, number, respective depth (P), and arrangement are chosen, dimensioned, and combined with the removable air cushions (10) so as to improve the shock-absorbing properties of the helmet and cover the parts of the user's head that are to be protected when the air cushions (8) are filled with air while allowing simple removal of the helmet when the air cushions are deflated, wherein the removable air cushions (10) are anchored in the flexible inner cap (6), and promote deformation of the flexible cap by bending or buckling under the pressure of the air cushions in the event of impact, which further improves shock-absorbing properties of the helmet;

wherein the chain of air cushions (10) is formed by two walls (83 and 85) of plastic material bound together at their periphery and includes:

a main band (9) formed by a plurality of air cushions for protecting the user's neck, a first side band (11, 12) joined to the main band (9) and formed by a plurality of air cushions for protecting one temple and one cheek of the user, a second side band (13, 14) joined to the main band (9) and formed by a plurality of air cushions for protecting the other temple and the other cheek of the user; and a central band (15) joined to the main band (9) between the first (11, 12) and second side bands (13, 14) and formed by a plurality of air cushions for protecting the user's neck and parietal bone, while the cavities are designed to respectively house each air cushion arranged in this way in order to protect the sensitive parts of the user's head.

2. The device as set forth in claim 1, characterized in that the thickness (E) of the flexible layer of the inner cap (6) is between 20 mm to 45 mm, inclusive is adaptable, and is adapted to fit different sizes of the helmet.

3. The device as set forth in claim 1, characterized in that the depth (P) of the cavities (100) is on the order of half the thickness (E/2) of the inner cap (6).

4. The device as set forth in claim 1, characterized in that the air cushions (10) are of identical size and spherical shape and have a diameter of between 2 and 6 cm, inclusive.

5. The device as set forth in claim 1, characterized in that the chain of air cushions comprises a valve (19) adapted to open outside of the helmet (2) so as to enable emergency deflation by rescuers.

6. The device as set forth in claim 5, characterized in that the valve (19) is adapted to be located on an external lateral face of the hard outer shell (4).

7. The device as set forth in claim 6, characterized in that the valve (19) comprises a tip (21) that is protected by a removable rigid shell.

8. The device as set forth in claim 1, characterized in that it further comprises an associated inflation system.

9. The device as set forth in claim 1, characterized in that the inflation pressure is on the order of 1.5 to 2.5 bar.

10. A helmet with a hard shell (4), characterized in that it comprises an internal protection device as set forth in claim 1.

* * * * *